US005295380A

United States Patent [19]

Hioki et al.

[11] Patent Number: 5,295,380

[45] Date of Patent: Mar. 22, 1994

[54] EDGING MILL FOR SECTION ROLLING

[75] Inventors: Takeshi Hioki; Toru Ikezaki, both of Kitakyushu; Yasushi Horiuchi; Kazufumi Hirose, both of Sakai; Yoshun Yamamoto; Masanori Fujiwara, both of Kitakyushu, all of Japan

[73] Assignee: Nippon Steel Corporation, Tokyo, Japan

[21] Appl. No.: 928,435

[22] Filed: Aug. 12, 1992

[30] Foreign Application Priority Data

Aug. 15, 1991 [JP] Japan ..... 3-228558
Sep. 19, 1991 [JP] Japan ..... 3-239187
May 26, 1992 [JP] Japan ..... 4-133907

[51] Int. Cl.[5] ..... B21B 27/02; B21B 31/16

[52] U.S. Cl. ..... 72/224; 72/239

[58] Field of Search ..... 72/224, 225, 238, 248, 72/252.5, 239

[56] References Cited

U.S. PATENT DOCUMENTS 4,966,026 10/1990 Nishino ..... 72/366.2
5,031,435 7/1991 Seto et al. ..... 72/238

FOREIGN PATENT DOCUMENTS 698966 11/1940 Fed. Rep. of Germany .
1801883 10/1968 Fed. Rep. of Germany .
62-077107 9/1987 Japan .
63-199001 8/1988 Japan .
2068283 8/1981 United Kingdom .

*Primary Examiner*—Lowell A. Larson
*Assistant Examiner*—Thomas C. Schoeffler
*Attorney, Agent, or Firm*—Wenderoth, Lind & Ponack

[57] ABSTRACT

An edging mill for section rolling has a pair of horizontal rolls, each horizontal roll including a pair of axially spaced horizontal roll segments supported by driven horizontal roll shafts. Eccentric rings are disposed between the two horizontal roll segments making up each horizontal roll and are rotatably mounted on the horizontal roll shaft. The eccentric rings are eccentric to the horizontal rolls. Web-restraining ring rolls each comprise a pair of web-restraining roll segments rotatably fitted over the periphery of the eccentric rings concentrically thereto. A web-restraining ring roll positioning device rotates the eccentric rings. While the horizontal rolls roll the flange edges of the section, the web-restraining ring rolls hold the web of the section therebetween. The position of the web-restraining ring rolls with respect to the horizontal rolls changes with the rotating angle of the eccentric rings. The position of the web-restraining ring rolls is adjusted according to the flange thickness of the section.

20 Claims, 9 Drawing Sheets

EDGING MILL FOR SECTION ROLLING

BACKGROUND OF THE INVENTION

1. Field of the Invention

This invention relates to rolling mills for edging metal sections, and more particularly to rolling mills for edging H- and other similar sections having gap-variable rolls of the eccentric ring type and having shiftable rolls in the roll axial direction. An edge rolling mill according to this invention permits rolling, for example, H-sections with different web heights and flange widths by simply adjusting the gap between drive side and work side rolls off the mill line, without changing the rolls themselves.

2. Description of the Prior Art

The conventional edge rolling mill that applies rolling to the flanges of an H- or other similar section is provided downstream of a universal mill that rolls the section in several passes.

When multi-pass rolling is performed on the conventional one-piece edge rolling mill, however, a gap S forms between a web 4 of an H-section 1 and a horizontal roll 8 as shown in FIG. 1 (*a*). As a consequence, a flange 2 of the H-section 1 causes buckling 6 as shown at FIG. 1 (*b*) or the web 4 becomes off-centered with respect to the flanges 2 as shown in FIG. 1 (*c*).

To solve this problem, Japanese Provisional Patent Publication No. 77107 of 1987 proposed an eccentric-ring edge rolling mill which comprises separate pairs of horizontal rolls to work on the flange edges of the section being rolled and ring rolls to hold its web. The web-restraining ring rolls are eccentric with respect to the horizontal rolls and always in contact with the web of the section. This eccentric-ring edge rolling mill 11 is made up of a pair of horizontal rolls 13, with a rotatable eccentric ring 15 fitted over each horizontal roll 13 through a bearing 14, as shown in FIGS. 2 and 3. Then, a rotatable web-restraining ring roll 17 is fitted over the eccentric ring 15 through a bearing 16. A worm wheel 18 provided on the eccentric ring 15 and a worm 19, in combination, rotate the eccentric ring 15, thereby positioning the web-restraining ring roll 17 eccentric to the horizontal roll 13.

This edge-rolling mill 11 has several shortcomings. The need to leave a large enough space for a device to apply a driving force to the inner side of the eccentric ring 15 makes it difficult to bring the two eccentric rings 15 closer. This, in turn, does not permit reducing the gap between the two web-restraining ring rolls 17 adequately and, therefore, securing a large enough variable range of web height. As mentioned before, this mill 11 is made up of a pair of horizontal rolls 13 each of which is fitted over a horizontal roll shaft 12 and carries therearound a rotatable web-restraining ring roll 17 having an eccentric ring 15. Because of this construction, the web-restraining ring rolls 17 are not firmly supported. The lack of their stability and rigidity does not permit rolling with heavy reduction. Besides, the large diameter difference between the horizontal rolls 13 and web-restraining ring rolls 17 does not permit the rolling of a section 1 with small flange thickness on the same mill.

SUMMARY OF THE INVENTION

The object of this invention is to provide an edging mill for section rolling that permits rolling metal sections having different web heights and flange widths by simply adjusting the gap between the rolls thereof of the mill line, without changing the rolls themselves, with a view to solving the above problems with the conventional rolling mills.

To achieve this object, an edging mill for section rolling according to this invention comprises a pair of horizontal rolls. Each horizontal roll comprises a pair of axially spaced horizontal roll segments supported by driven horizontal roll shafts. Eccentric rings are disposed between the two horizontal roll segments making up each horizontal roll and are rotatably mounted on the horizontal roll shaft. The eccentric rings are eccentric to the horizontal rolls. Web-restraining ring rolls each comprise a pair of web-restraining roll segments rotatably fitted over the periphery of the eccentric rings concentrically thereto. A web-restraining ring roll positioning device rotates the eccentric rings.

While the horizontal rolls roll the flange edges of the section, the web-restraining ring rolls hold the web of the section therebetween. The position of the web-restraining ring rolls with respect to the horizontal rolls changes with the rotating angle of the eccentric rings. The position of the web-restraining ring rolls is adjusted according to the flange thickness of the section.

Because the eccentric rings are disposed between the pair of web-restraining ring rolls, the driving torque from the web-restraining ring roll positioning device can be transmitted to the periphery of the eccentric rings. This permits reducing the space between the web-restraining ring roll segments, which, in turn, permits rolling, for example, H-sections with low web height, and expands the range of rollable section sizes.

The eccentric ring may be made up of a pair of axially spaced eccentric ring segments rotatably mounted on the horizontal roll shaft. In this case, the web-restraining ring roll positioning device integrally rotate the pair of eccentric ring segments. The eccentric rings are rotated by a rotary motor or a hydraulic cylinder through a gear or link transmission mechanism. The axially separated eccentric rings and web-restraining ring rolls permit expanding the range of rollable size further.

A drive unit separated from the horizontal roll drive unit may be connected to the web-restraining ring rolls. In this case, the web-restraining ring rolls are also rotated while the section is being rolled. The rotating ring rolls eliminates slip between themselves and the piece being rolled, and prevents the production of scratches on the web of the piece. This design also relieves the shock and damage to the web-restraining ring rolls that bites the entering piece.

Also, means to check the rotation of the eccentric rings may be provided in the edge rolling mill having the web-restraining ring rolls interlocked to the drive unit. This provision permits the dressing of the horizontal rolls. Also, the periphery or sides of the web-restraining ring can be dressed by rotating them.

BRIEF DESCRIPTION OF THE DRAWINGS

FIG. 1 (*a*) shows the gap between a horizontal roll and the web of a section being rolled.

FIG. 1 (*b*) shows a buckling in a flange.

FIG. 1 (*c*) shows an off-centered web.

DESCRIPTION OF THE PREFERRED EMBODIMENTS

Figure 1A:
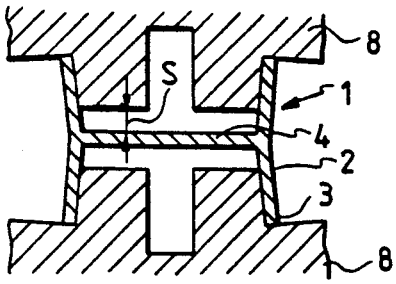
FIG. 1(a) PRIOR ART
FIG. 1 (*a*) to (*c*) illustrate a rolling condition on a conventional edge rolling mill.
Figure 1B:
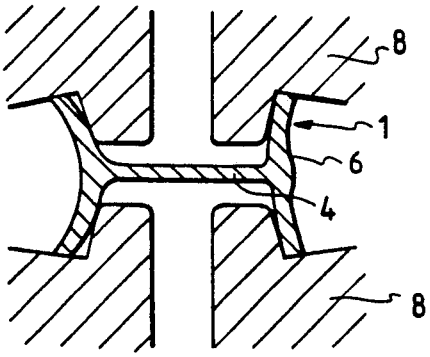
FIG. 1(b) PRIOR ART
Figure 1C:
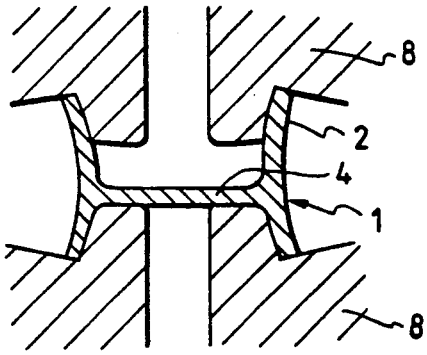
FIG. 1(c) PRIOR ART
Figure 2:
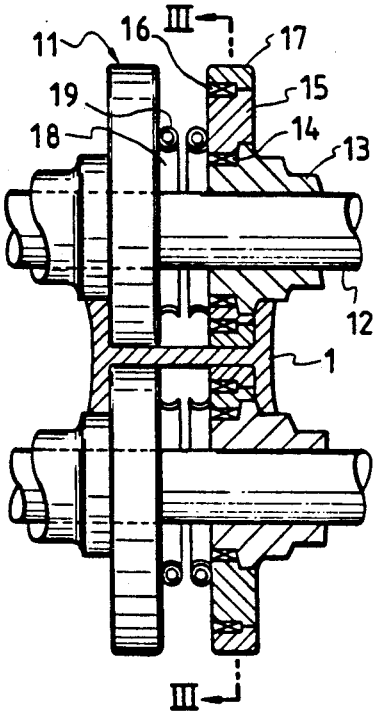
FIG. 2 PRIOR ART
FIG. 2 is a vertical cross-sectional view showing the rolls of a conventional eccentric-ring edge rolling mill.
Figure 3:
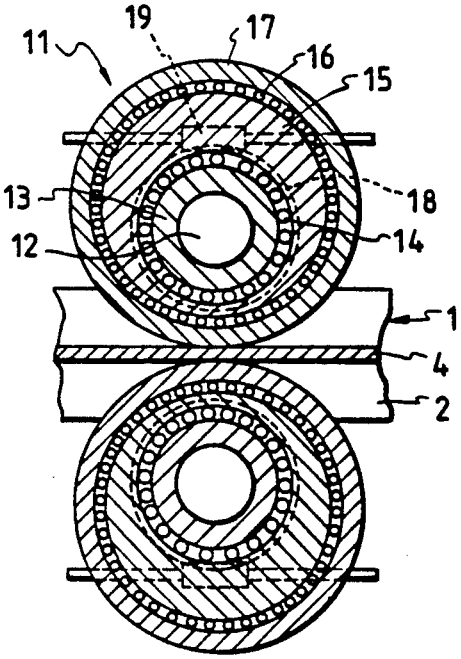
FIG. 3 PRIOR ART
FIG. 3 is a cross-sectional view taken along the line III—III of FIG. 2.
Figure 4:
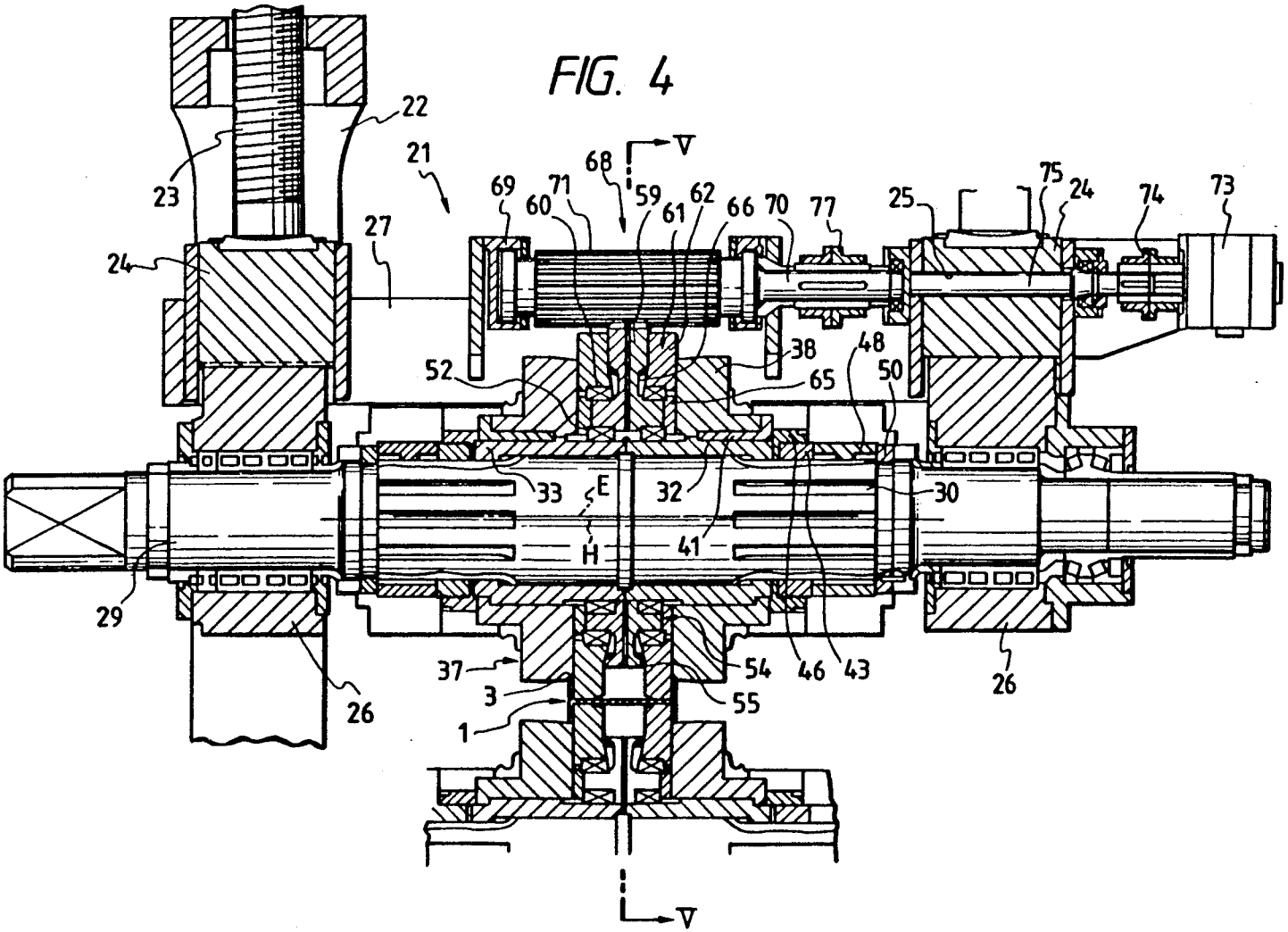
FIG. 4 is a cross-sectional view showing a principal part of an edge rolling mill according to this invention.
Figure 5:
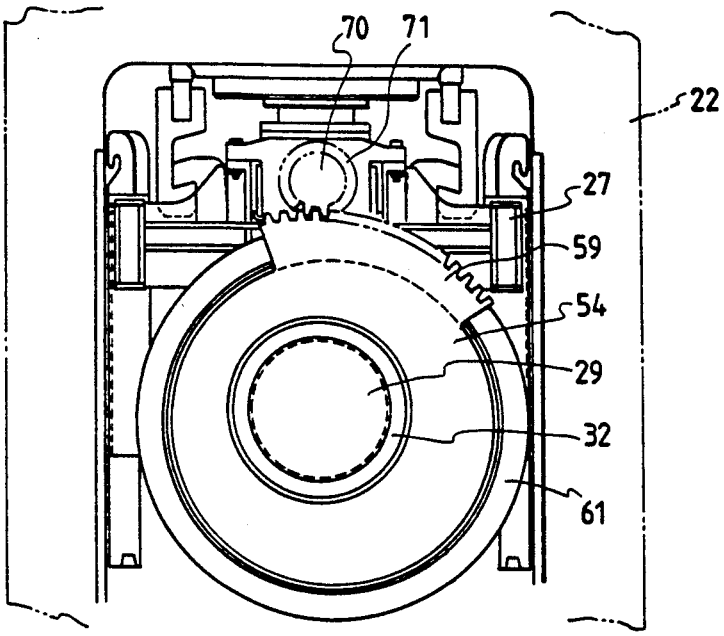
FIG. 5 is a cross-sectional view taken along line V—V of FIG. 4.
Figure 6:
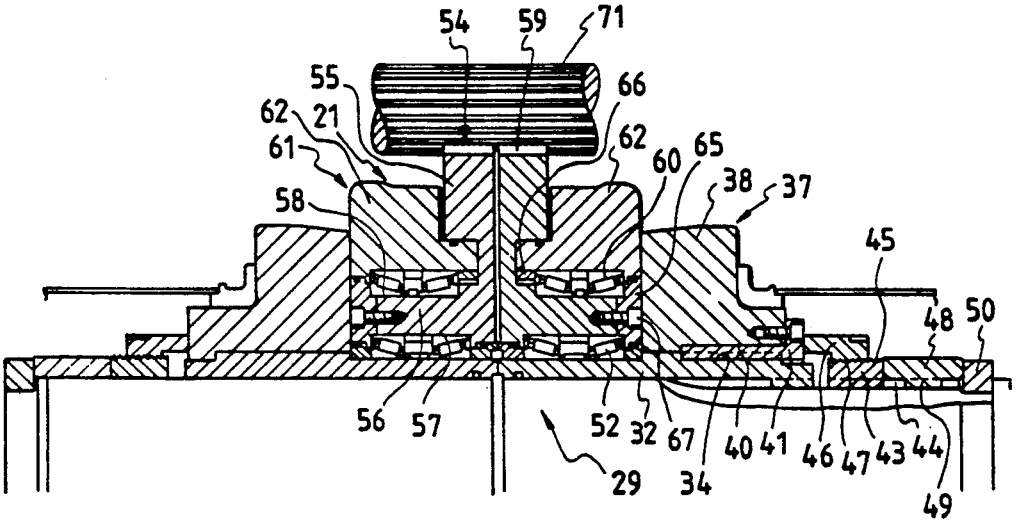
FIG. 6 is a cross-sectional view enlarging a part of FIG. 4.

FIGS. 4 to 6 show an example of a rolling mill for edging H sections according to this invention. Though this edge rolling mill has a pair of horizontal rolls, one on top of the other, the description given below is confined to the principal parts on the upper side thereof. Description of the lower part is omitted as it is similar to the upper part.

As shown in FIGS. 4 and 5, a roll bearing box 26 is provided below a screwdown mechanism 23 (a drive motor and some other component parts are not shown here) attached to a housing 22 through an intermediate block 24. The roll bearing box 26 supports a horizontal roll shaft 29 with external splines 30. A motor to drive a horizontal roll 37 is connected to the horizontal roll shaft 29 through a spindle and shaft coupling (not shown).

The horizontal roll 37 fits over the horizontal roll shaft 29 through a sleeve 32. The sleeve 32 is axially divided into two segments. At one end of each sleeve segment are provided internal splines 33 into which the external splines 30 on the horizontal roll shaft 29 fit. The sleeve 32 fits over the horizontal roll shaft 29 and is slidable along the axis thereof. The horizontal roll 37 consists of a pair of axially bisected horizontal roll segments 38. Each horizontal roll segment 38 fits over the sleeve segment 32. Key grooves 34 and 40 are cut in the external surface of the sleeve segment 32 and the internal surface of the horizontal roll segment 38. A key 41 is inserted in the key grooves 34 and 40 fastens the horizontal roll segment 38 to the sleeve segment 32. An adjusting ring 43 having splines 44 along the internal surface thereof fits over the horizontal roll shaft 29, next to the sleeve segment 32. An internal thread 47 on a holding ring 46 engages with an external thread 45 on the adjusting ring 43. The front end of the holding ring 46 pushes the rear end of the horizontal roll segment 38. A spacer 48 with splines 49 along the internal surface thereof fits over the horizontal roll shaft 29, next to the adjusting ring 43. Furthermore, a stopper ring 50 fits over the horizontal roll shaft 29, next to the spacer 48. When the holding ring 46 is turned, the adjusting ring 43 moves backward and stops on coming in contact with the spacer 48, whereas the holding ring 46 moves forward to bring the horizontal roll segment 38 into a fixed position by pushing the rear end thereof.

The horizontal roll shaft 29 supports an eccentric ring 54 and a web-restraining ring 61 therethrough.

The eccentric ring 54 consists of two axially divided eccentric ring segments 55. The center E of the outer boundary of a hub 56 on the eccentric ring segment 55 is displaced from the center of the inner boundary of the hub 56 or the center H of the horizontal roll shaft 29. The eccentric ring segments 55 disposed between the horizontal roll segments 38 fit over the horizontal roll shaft 29 through the sleeve 32 and a bearing 52. Partial gear teeth 59 are provided on a portion of the circumference of each eccentric ring segment 55. The partial toothed gear 59 projects beyond the circumference of the web-restraining ring roll 61, described later, with the center of the pitch circle thereof agreeing with the center H of the horizontal roll shaft.

The web-restraining ring roll 61 consists of two ring roll segments 62 bisected along the axis of the horizontal roll shaft. Each ring roll segment 62 is disposed between the horizontal roll segment 38 and eccentric ring segment 55 and fit over the outer boundary 58 of the hub of the eccentric ring segment 55 through a bearing 60. As mentioned before, the outer boundary 58 of the hub of the eccentric ring segment 55 supporting the web-restraining ring roll 61 is eccentric to the inner boundary 57 thereof. Therefore, the position of the web-restraining ring roll 61 with respect to the horizontal roll 37 changes with the rotating angle of the eccentric ring 54.

A bearing cover 65 is fastened to the hub 56 of the eccentric ring segment 55 with bolts 67 so as to press the outside of the bearings 52 and 60. The bearing cover 65 and an inner bearing cover 66 keep the eccentric ring segment 55 and ring roll segment 62 close together along the horizontal roll shaft. A web-restraining ring roll positioning device 68 is mounted on an intermediate block case 27. The intermediate block case 27 supports a pinion shaft 70 through a bearing 69. Also, a motor 73 is connected to the intermediate block case 27, with a spindle 75 connected to the output shaft of the motor 73 through a shaft hole 25 in the intermediate block 24 and a coupling 74. The pinion shaft 70 is connected to the spindle 75 through a coupling 77. A pinion 71 on the pinion shaft 70 engages with the partial toothed gear 59 on each of the eccentric ring segments 55. The pinion 71 has a large enough width to invariably remain engaged with the partial toothed gear 59 on the eccentric ring 54 even when the space between the eccentric ring segments 55 expands. The motor 73 incorporates a brake to prevent the rotation of the eccentric ring 54 and hold the web-restraining ring roll 61 in position after the position of the web-restraining ring roll 61 with respect to the horizontal roll 37 has been adjusted and fixed. Also, a pulse generator (not shown) to sense the rotating angle of the eccentric ring 54 or the position of the web-restraining ring roll 61 is attached to the motor 73.

In the edge rolling mill 21 just described, the horizontal roll 37 rolls the flange edges 3 of an H-section 1, whereas the web-restraining ring roll 61 comes in contact with and restrains the web 4 of the H-section 1. While the horizontal roll 37 is driven by a motor (not shown), the web-restraining ring roll 61 is rotated by the frictional force produced by the contact thereof with the web 4. The position of the web-restraining roll 61 is adjusted according to the flange widths of H-section 1. To be more specific, the web-restraining ring roll positioning device 68 rotates the eccentric ring 54 to adjust the position of the web-restraining ring roll 61 so that the top and bottom ring rolls 61 come in contact with the web 4 to restrain it in a proper position or with a proper pressure.

Figure 7:
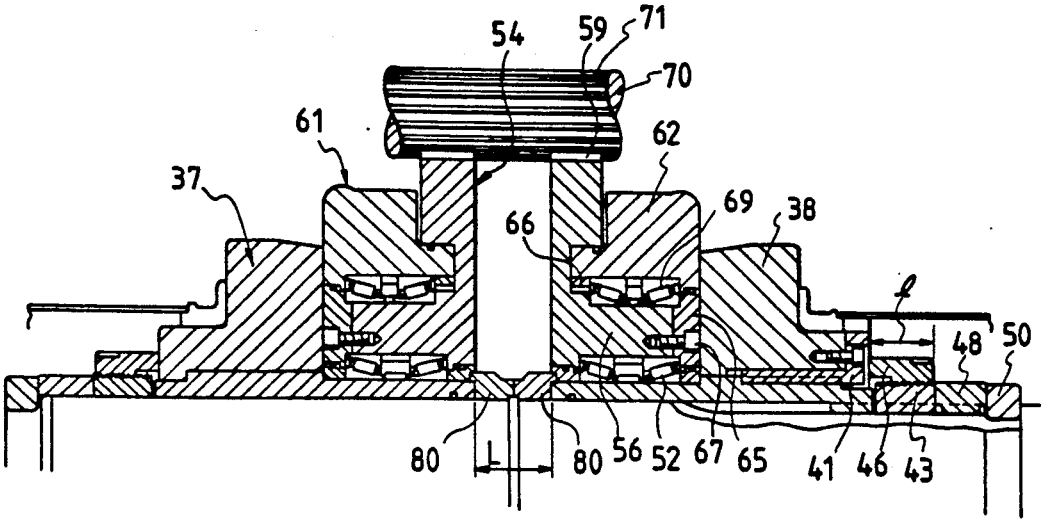
FIG. 7 shows a collar interposed between the sleeves shown in FIG. 6.
Figure 8:
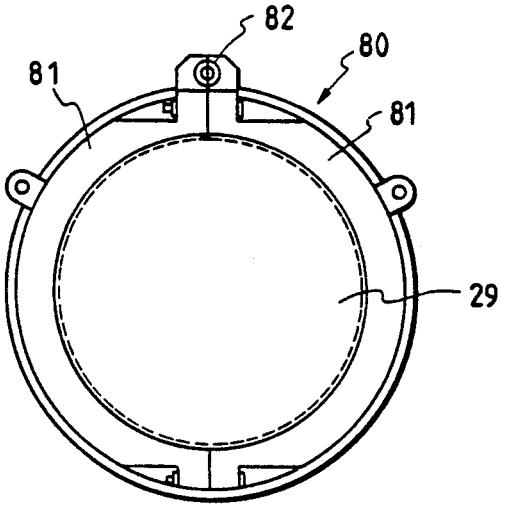
FIG. 8 is a side elevation of the sleeve shown in FIG. 7.

The horizontal roll 37, eccentric ring 54 and web-restraining ring roll 61 of this embodiment are bisected along the axis of the horizontal roll. Therefore, the width of the horizontal roll 37 and web-restraining ring roll 61 can be changed together with the width of the eccentric ring 54, as shown in FIG. 7. The gap between the segments making up these rolls is changed by inserting a pair of collars 80 between the sleeves 32. The collar 80 is made up of two collar segments 81. Therefore, the collar 80 can be fitted over the horizontal roll shaft 29 by simply moving the sleeve 32 carrying the horizontal roll 37 and other members along the axis of the horizontal roll shaft 29, without removing the sleeve 32 and other members therefrom. The two collar segments 81 fitted over the horizontal roll shaft 29 are fastened together with a bolt 82 to make up the collar 80. When the gap L is changed by means of the collar 80, the holding ring 46 is turned to adjust the combined length of the adjusting ring 43 and holding ring 46 according to the gap L. If it is necessary to change the length of the spacer 48, the spacer 48 is replaced with another spacer of the desired length. The spacer 48 may be eliminated by increasing the length of the adjusting ring 43 or the stopper ring 50. The setup of the roll gap is completed by pressing the horizontal roll 37 with the holding ring 46. At this time, the pinion 71 of the web-restraining ring roll positioning device 68 is locked by a drive unit.

In this embodiment, the web-restraining ring roll 61 carrying the horizontal roll 37 and eccentric ring 54 is integrally mounted on the sleeve 32. Therefore, the roll gap can be easily changed by simply moving the sleeve 32. The eccentric ring and web-restraining ring roll are not fitted over the horizontal roll. This stabilizes the mounting of the web-restraining ring roll, provides a rigid mill construction, permits a heavy-draft rolling and reduces the gap between the web-restraining ring rolls to a minimum. Also, the absence of the drive unit for the web-restraining ring roll positioning device between the web-restraining ring rolls facilitates the insertion of the collar 80 in the setup of roll gap. The partial toothed gear 59 on the eccentric ring 54 projects beyond the periphery of the web-restraining ring roll 61. This permits moving the eccentric ring segment 55 axially while keeping the partial toothed gear 59 in engagement with the pinion 71. Therefore, the roll gap can be readily changed without changing the relative position of the eccentric ring 54 with respect to the horizontal roll 37 or web-restraining ring roll 61. Furthermore, the position of the sleeve 32 carrying the horizontal roll 37 and the web-restraining ring roll 61 can be easily and surely adjusted by adjusting the length of the adjusting ring 43 and by means of the holding ring 46 fitted over the adjusting ring 43. The splines 30 on the horizontal roll shaft 29 may be replaced with key grooves extending along the horizontal roll shaft. Then, the torque is transmitted from the horizontal roll shaft to the sleeve through a sliding key.

The eccentric ring 54, which is made up of two eccentric ring segments 55 in the embodiment just described, may also consist of a one-piece ring as in another embodiment described later.

The following paragraphs describe another embodiment of this invention. In the following description, the parts and devices similar to those illustrated in FIGS. 4 to 7 are designated by similar reference characters, with no detailed description.

Figure 9:
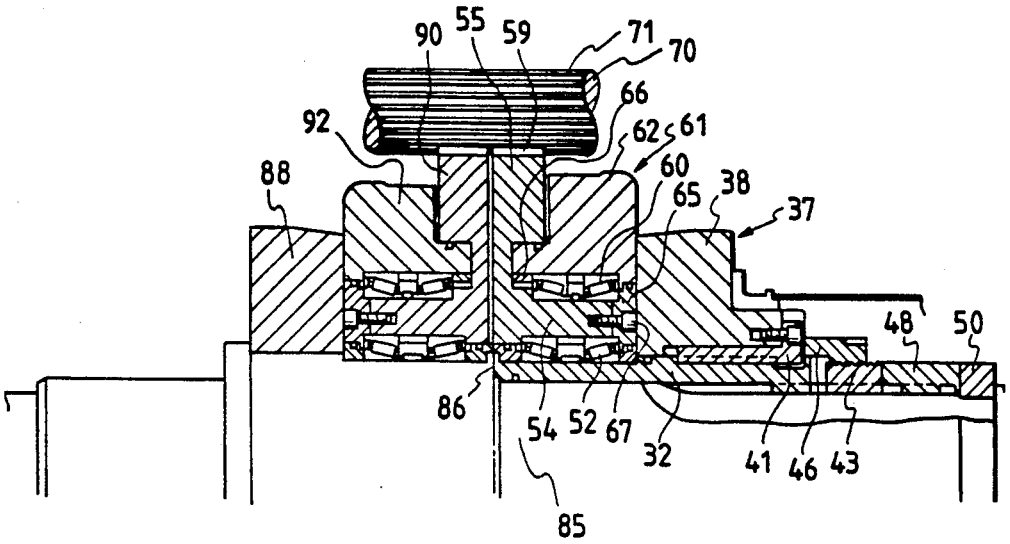
FIG. 9 is a partially cross-sectional view of a modification of the edge rolling mill shown in FIG. 4.
Figure 10:
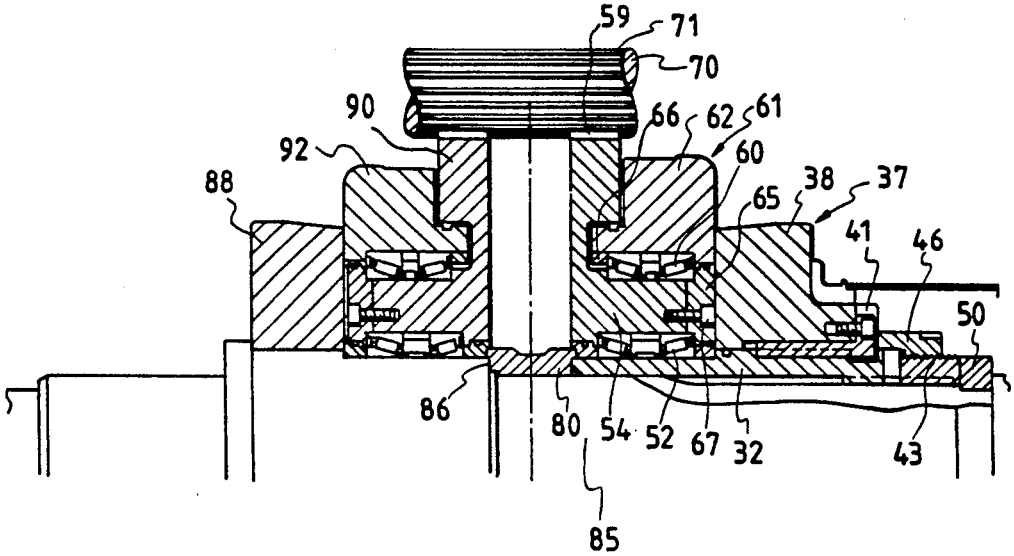
FIG. 10 shows a collar interposed between the stepped part of the horizontal roll shaft and the sleeve shown in FIG. 9.

When the direction of the rolling mill stand or material guides can be shifted perpendicularly to the pass line, provision to move the horizontal roll segment, eccentric ring segment and web-restraining ring roll segment on only one side along the roll shaft is enough. FIG. 9 shows a horizontal roll segment 88 and an eccentric ring roll segment 90 attached directly, instead of by way of a sleeve, to a horizontal roll shaft 85. Therefore, the horizontal roll segment 88, eccentric ring segment 90 and web-restraining ring roll segment 92 do not move along the horizontal roll shaft. By contrast, a horizontal roll segment 38, eccentric ring segment 55 and web-restraining ring roll segment 62 on the right are attached to a horizontal roll shaft 85 through a sleeve 32 and, therefore, movable along the horizontal roll shaft. FIG. 10 shows the roll gap expanded by inserting a collar 80 between a stepped part 86 of the horizontal roll shaft 85 and the sleeve 32. The horizontal roll segment 88 may be either fastened to or integrated with the horizontal roll shaft 85.

Figure 11:
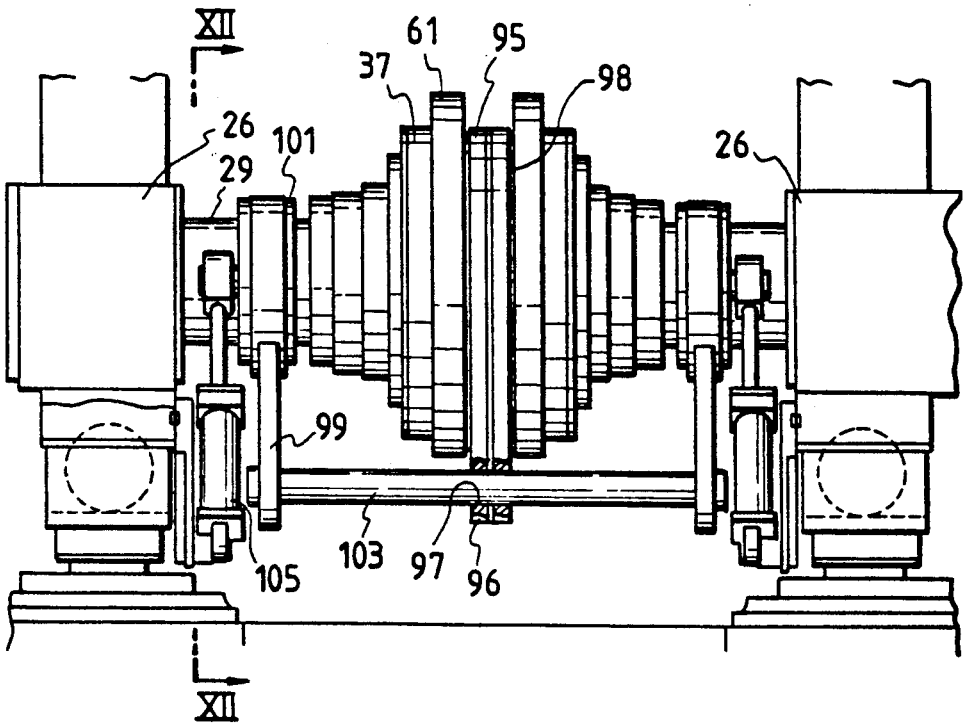
FIG. 11 is a front view of another embodiment of an eccentric-ring drive unit.
Figure 12:
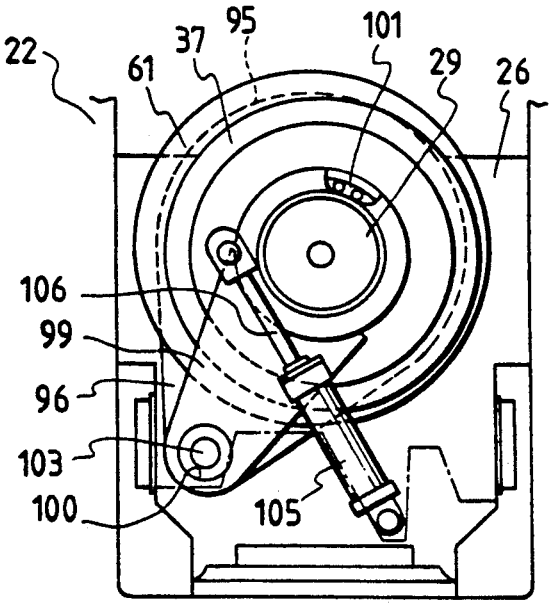
FIG. 12 is a cross-sectional view taken along line XII—XII of FIG. 11.

Now another embodiment having a different eccentric ring drive mechanism will be described by reference to FIGS. 11 and 12.

An eccentric ring 95 has an arm-like projection 96 protruding beyond the periphery of a web-restraining ring roll 61 and is perforated with a shaft hole 97. The web-restraining ring roll 61 rotatably fits over a hub 98 of the eccentric ring 95. An arm 99 having a shaft hole 100 at the tip thereof rotatably fits over the horizontal roll shaft 29 through a bearing 101. The eccentric ring 95 and arm 99 are coupled together by means of a coupling shaft 103 extending along the horizontal roll shaft 29 and slidably inserted in the shaft holes 97 and 100. The base end of a hydraulic cylinder 105 is swingably attached to a roll bearing box 26, with a cylinder rod 106 connected to the arm 99 by a pin. The hydraulic cylinder 105 rotates the eccentric ring 95 through the arm 99 to adjust the position of the web-restraining ring roll 61.

Figure 13:
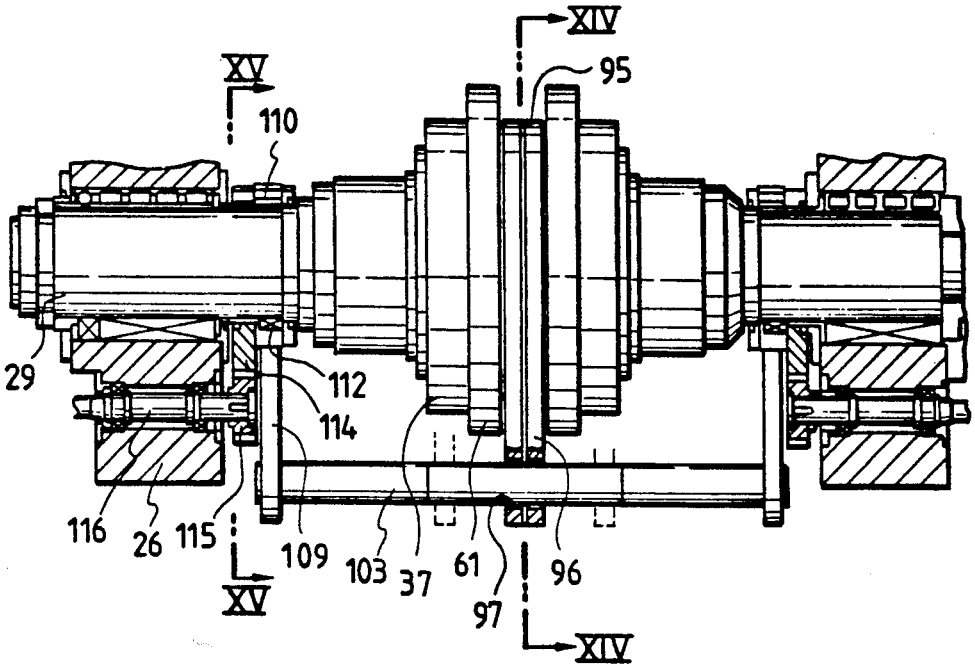
FIG. 13 is a partially cross-sectional front view of another embodiment of an eccentric-ring drive unit.
Figure 14:
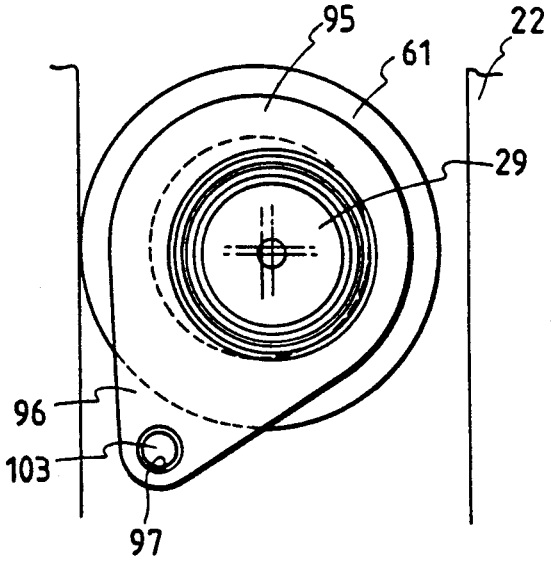
FIG. 14 is a cross-sectional view taken along line XIV—XIV of FIG. 13.
Figure 15:
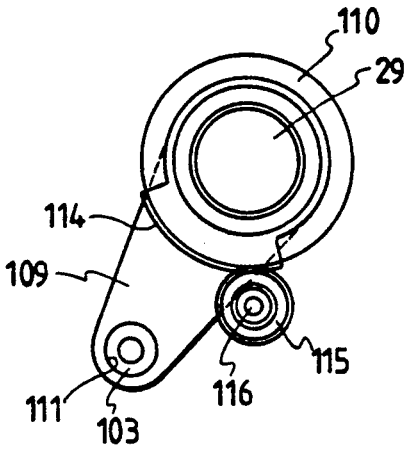
FIG. 15 is a cross-sectional view taken along line XV—XV of FIG. 13.

FIGS. 13, 14 and 15 illustrate a different embodiment having a still another eccentric ring drive mechanism.

In this embodiment, a combination of a toothed gear and a motor is used, in place of a hydraulic cylinder, to rotate an arm. An arm 109 is attached to a horizontal roll shaft 29 through a bearing 112. A coupling shaft 103 is slidably inserted in a shaft hole 97 in the projected part 96 of an eccentric ring 95. The eccentric ring 95 and arm 109 are connected by the coupling shaft 103, whose end is inserted in a shaft hole 111 in the arm 109. A partial toothed gear 114 is fastened to the side of the hub 110 of the arm 109. A pinion 115 to engage with the partial toothed gear 114 is attached to a roll bearing box 26. A motor (not shown) connected to a pinion shaft 116 rotates the pinion 115. The motor rotates the eccentric ring 95 through the arm 109 to adjust the position of a web-restraining ring roll 61.

In the two embodiments just described, the eccentric ring 95 and drive unit can be connected by a simple mechanism because the projected part 96 of the eccentric ring 95 is connected with the arm 99 or 109 by the coupling shaft 103. When changing the roll gap, the eccentric ring 95 can be moved along the horizontal roll shaft 29. The arm 99 or 109 and the drive unit thereof are placed near the roll bearing box 26 or, in other words, away from the pass line of an H-section or other piece. This arrangement minimizes the influence of the radiant heat and scale of the piece on the working part of the roll shaft. The absence of other parts than the roll shaft in the rolling area permits simple mill design, easy roll gap adjustment, and easy maintenance.

An embodiment described below has positively driven web-restraining ring rolls. Though the eccentric ring used in this embodiment is monobloc, it may be divided along the roll shaft as in the embodiments described before.

Figure 16:
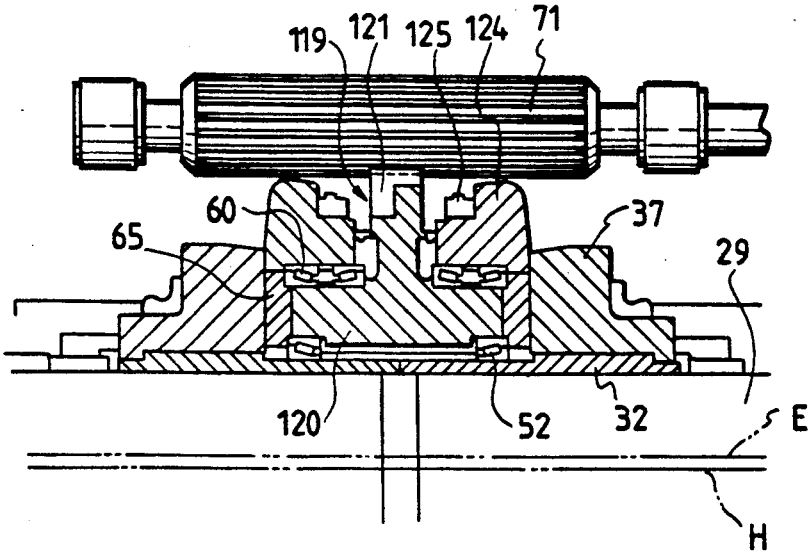
FIG. 16 is a cross-sectional view of the rolls in an edge rolling mill equipped with a web-restraining ring roll drive unit.
Figure 17:
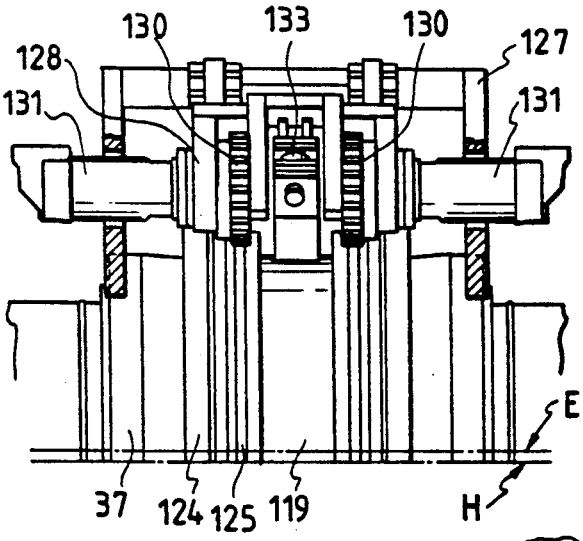
FIG. 17 is a front view of the web-restraining ring roll drive unit of the edge rolling mill shown in FIG. 16.
Figure 18:
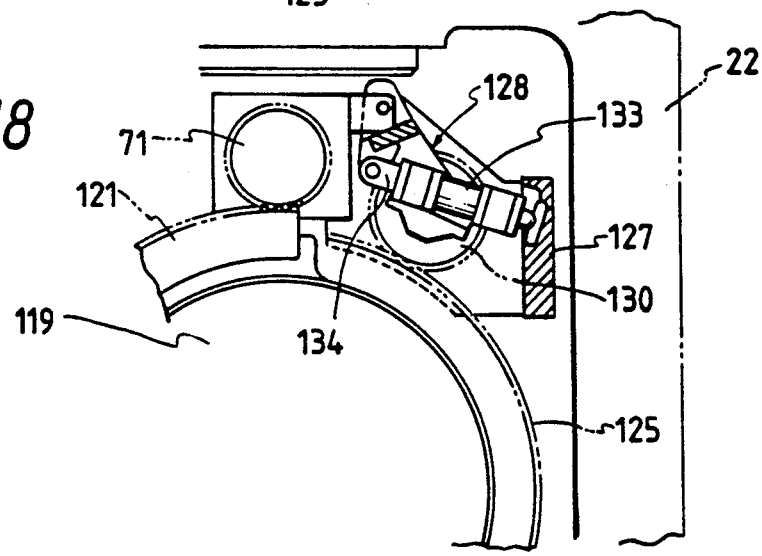
FIG. 18 is a side elevation of the drive unit shown in FIG. 17.

As shown in FIG. 16, a monobloc eccentric ring 119 is attached to a sleeve 32 through a bearing 52. A web-restraining ring roll 124 is attached to the periphery of the hub 120 of the eccentric ring 119 through a bearing 60. A partial toothed gear 121 is provided on the periphery of the eccentric ring 119. The device to rotate the eccentric ring 119 is the same as in the embodiments described before. FIGS. 17 and 18 show a toothed gear 125 to drive the web-restraining ring roll provided on the periphery of the web-restraining ring roll 124. A web-restraining roll drive pinion 130 and a hydraulic motor 131 to drive the toothed gear 125 is attached to a movable frame 128 which, in turn, is swingably attached to a fixed frame 127. While a hydraulic cylinder 133 is swingably attached to the fixed frame 127, a cylinder rod 134 is connected to the movable frame 128 by a pin.

In rolling, the horizontal roll 37 driven by a drive unit (not shown) rolls the flange edge 3 of the H-section 1, whereas the web-restraining ring roll 124 driven by the hydraulic motor 131 restrains the web 4 thereof. No slip occurs between the horizontal and web-restraining ring rolls 37 and 124 and the piece being rolled because both rolls are rotated during rolling. The rotating speed of the web-restraining ring roll 124 must be adjusted so that the peripheral speed thereof becomes substantially equal to the peripheral speed of the horizontal roll. When rolling a H-section whose web thickness differs from that of the preceding one, the eccentric ring 119 is displaced by moving the eccentric ring drive pinion 71, with the web 4 restrained by means of the web-restraining ring roll 124. At this time, the engaging position of the web-restraining ring roll drive gear wheel 125 and pinion 130 changes with the eccentricity of the eccentric ring 119. Accordingly, the hydraulic cylinder 133 on the fixed frame 127 invariably applies a given pressure so that the web-restraining ring roll drive pinion 130 always follows the web-restraining ring roll drive gear wheel 125.

Figure 19:
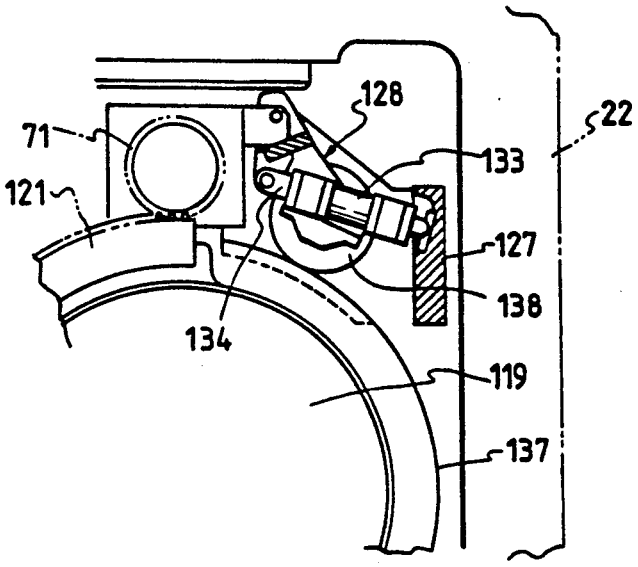
FIG. 19 is a side elevation showing another embodiment of a web-restraining ring roll drive unit.

In an embodiment shown in FIG. 19, a web-restraining ring roll 137 is rotated by means of a friction wheel 138 that is driven by a hydraulic motor 131 and pressed against the periphery thereof by a pressure applied by a hydraulic cylinder 133. The pressing mechanism consisting of the hydraulic motor 131, friction 138 and hydraulic cylinder 133 is the same as the one in the preceding embodiment.

In the last two embodiments, the rotation of the web-restraining ring rolls 124 and 137 that are in contact with the web of the piece eliminates the undesirable slip therebetween, prevents the occurrence of scratches on the web, and thus improves the quality of the rolled products. The engagement between the web-restraining ring roll drive gear wheel 125 and pinion 130 is always maintained regardless of the eccentricity of the eccentric ring 119 by applying a given pressure from a hydraulic cylinder 131 or other actuator. Thus, the drive unit of the web-restraining ring rolls 124 and 137 always and automatically bring them back into the desired position, without requiring the aid of a mill operator, whenever they get out of the position.

Figure 20:
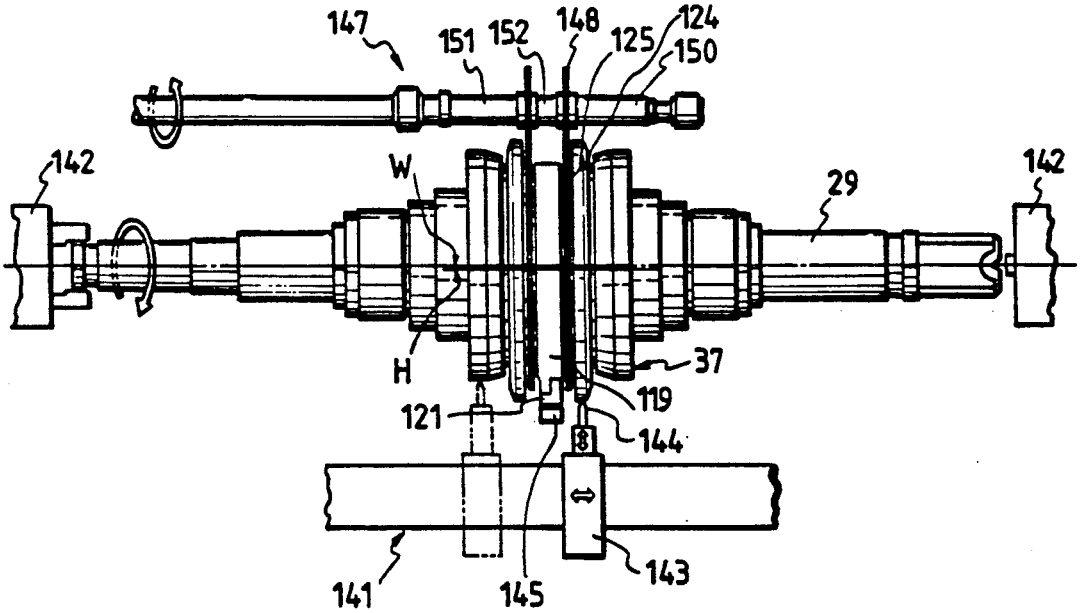
FIG. 20 shows a grinding condition of horizontal and web-restraining ring rolls.

Positive rotation of the web-restraining ring roll facilitates roll dressing as illustrated in FIG. 20.

Roll dressing is performed on a roll dresser 141 separated from the rolling mill stand, on to which an assembly of a horizontal roll 37, eccentric ring 119 and web-restraining ring roll 124 on a horizontal roll shaft 29 is removed from the edge rolling mill.

With the horizontal roll shaft 29 supported by a chuck 142, the horizontal roll 37 is dressed to the desired diameter by means of a cutting tool 144 mounted on the cutter head 143 of the roll dresser 141 that is applied against the horizontal roll 37 rotated by the chuck 124. At this time, the eccentric ring 119 is fixed by a stopper 145, whereas the web-restraining ring roll drive unit 147 stands still. Because of the bearing 52 between the eccentric ring 119 and the sleeve 32 on the horizontal roll shaft 29, the eccentric ring 119 and web-restraining ring roll 124 do not rotate even if the horizontal roll shaft 29 rotates (see FIG. 4). Still, the horizontal roll 37 alone is rotated about the horizontal roll shaft 29 through the horizontal roll shaft 29 and sleeve 32.

When dressing the web-restraining ring roll 124, the eccentric ring 119 is fixed by a stopper 145. Then, the web-restraining ring roll drive gear wheel 125 on the periphery of the web-restraining ring roll 124 is rotated about the center W of the web-restraining ring roll by the web-restraining ring roll drive unit 147 having a pinion 148 to engage therewith. At this time, the web-restraining ring roll 124 is in contact with the eccentric ring 119 through the bearing 60 (see FIG. 16). Therefore, the web-restraining ring roll 124 alone is rotated and dressed to the desired diameter by means of the cutting tool 144 on the cutter head 143 of the roll dresser 141. The unit to drive the horizontal roll shaft 29 stands still. The side of the web-restraining ring roll 124 is dressed by inserting an appropriate noninterfering two-piece spacer 150 between the horizontal roll 37 and web-restraining ring roll 124. Before inserting the spacer 150, the holding ring 46 on the horizontal roll 37 is loosened (see FIG. 4) to move the horizontal rolls 37 outward. Then, the bisected spacer 150 is inserted from outside. After this, the holding ring 46 is re-tightened, and the horizontal rolls 37 are moved inward to hold the spacer 150 therebetween.

When the web height is changed from one to another, the position of the web-restraining ring roll 124 must be changed. Then, the position of the web-restraining ring roll drive pinion 148 with respect to that of the ring roll can be adjusted appropriately by changing the spacers 151 and 152.

The horizontal roll 37 and the web-restraining ring roll 124 eccentric thereto in this embodiment can be dressed in an assembled form at a time on the same roll dresser 141. This results in a shorter roll dressing time, higher roll utilization rate, and increased productivity. Besides, the capability to change the position of the web-restraining ring roll drive gear wheel 125 permits dressing the rolls of the eccentric ring type edge rolling mill when changing the web height of the H-section from one to another.

What is claimed is:

1. An apparatus in an edging mill for section rolling, comprising:

a horizontal roll for rolling flange edges of a metal section being rolled, said horizontal roll comprising a pair of horizontal roll segments supported by a driven horizontal roll shaft, said horizontal roll segments being axially separated from each other;

an eccentric ring having a hub rotatably fitted over said horizontal roll shaft between said horizontal roll segments, said eccentric ring being eccentric to said horizontal roll on said horizontal shaft on which said eccentric ring is rotatably fitted;

a web-restraining ring roll rotatably fitted over said hub of said eccentric ring, said web restraining ring roll comprising a pair of web-restraining ring roll segments concentric with said eccentric ring and disposed between respective said horizontal roll segments and said eccentric ring and adapted to restrain the web of a metal section being rolled; and means for adjusting the position of said web-restraining ring roll by rotating said eccentric ring such that the position of the said web-restraining ring roll with respect to said horizontal roll changes with an angle of rotation of said eccentric ring, wherein said eccentric ring has a part for transmitting rotation to said eccentric ring disposed outside a periphery of said web-restraining ring roll.

2. The apparatus of claim 1, wherein:

said eccentric ring comprises a pair of eccentric ring segments that are axially separated from each other and rotatably fitted over said horizontal roll shaft; and said means for adjusting the position of said web-restraining ring roll integrally rotates said pair of eccentric ring segments.

3. The apparatus of claim 1, wherein:

said part of said eccentric ring comprises gear teeth on a periphery of said eccentric ring, and said means for adjusting the position of said web-restraining ring roll comprises a rotatable drive shaft parallel with said horizontal roll shaft, a pinion fastened to said drive shaft and engaged with said gear teeth and means for driving said drive shaft.

4. The apparatus of claim 1, wherein:

said part of said eccentric ring is a projected portion having a shaft hole therein, and said means for adjusting the position of said web-restraining ring roll comprises an arm rotatable about the axis of said horizontal roll, a means for driving said arm, a shaft hole in said drum and a coupling shaft parallel to said horizontal roll shaft fitted in said shaft holes of said projected portion and said arm.

5. The edging mill of claim 4, wherein said means for driving said arm comprises a hydraulic cylinder having a cylinder rod connected to said arm.

6. The apparatus of claim 4, wherein said means for driving said arm comprises a rotary motor connected to said arm through a gear train.

7. The apparatus of claim 1, and further comprising:

a pair of sleeves that are slidably but unrotatably fitted over said horizontal roll shaft, wherein said horizontal roll is fastened, and said eccentric ring is rotatably fitted, over each said sleeve.

8. The apparatus of claim 7, and further comprising:

positioning means for axially positionally fixing said horizontal roll on said horizontal roll shaft.

9. The apparatus of claim 1, and further comprising:

a drive unit for rotating said web-restraining ring roll separately from said horizontal roll.

10. The apparatus of claim 9, wherein said drive unit comprises a set of gear teeth formed on a periphery of said web-restraining ring roll, a pinion engaging said gear teeth and a rotary motor for driving said pinion.

11. The apparatus of claim 10, and further comprising:

means for pressing said pinion against said gear teeth of said web-restraining ring roll so as to maintain said pinion in engagement with said gear teeth and follow positional changes of said web-restraining ring roll.

12. The apparatus of claim 9, wherein said drive unit comprises a friction wheel in contact with a periphery of said web-restraining ring roll and a motor for driving said friction wheel.

13. The apparatus of claim 12, and further comprising:

means for pressing said friction wheel against the periphery of said web-restraining ring roll so as to maintain said friction wheel in engagement with the periphery of said web-restraining ring roll and follow positional changes of said web-restraining ring roll.

14. The apparatus of claim 9, and further comprising:

an edge rolling roll dresser comprising a means for supporting said horizontal roll shaft, a cutter head holding a cutter tool so as to be movable diametrically of said horizontal roll shaft and slidable in the axial direction of said horizontal roll shaft and means for stopping the rotation of said eccentric ring.

15. The apparatus of claim 14, wherein said edge rolling roll dresser has a spacer inserted between said horizontal roll and said web-restraining ring roll.

16. The apparatus of claim 1, wherein said eccentric ring is rotatably fitted over said horizontal roll shaft by a rotary bearing and said web restraining ring roll is rotatably fitted over said eccentric ring by a rotary bearing.

17. The apparatus of claim 1, wherein each said web-restraining ring roll segment has an outer side surface abutting an inner side surface of a respective said horizontal roll segment.

18. The apparatus of claim 1, wherein said eccentric ring comprises a pair of eccentric ring segments, each said eccentric ring segment having a respective said web-restraining ring roll segment fitted thereover between said eccentric ring segment and a respective said horizontal roll segment.

19. The apparatus of claim 18, wherein each said eccentric ring segment, together with a respective said web-restraining ring roll segment and a respective said horizontal roll segment, is mounted on a means for axially moving said eccentric ring segment on said horizontal roll shaft.

20. The apparatus of claim 19, wherein said means for axially moving comprises a sleeve axially adjustably fitted on said horizontal shaft.

* * * * *